United States Patent [19]

Forrest et al.

[11] Patent Number: 4,796,704

[45] Date of Patent: Jan. 10, 1989

[54] DROP BALL SUB-ASSEMBLY FOR A DOWN-HOLE DEVICE

[75] Inventors: John Forrest, Aberdeen; William Stewart, New Pigsligo; Rory Tulloch, Aberdeen, all of Scotland

[73] Assignee: Drilex UK Limited, New Pigsligo, Scotland

[21] Appl. No.: 27,231

[22] PCT Filed: Jul. 15, 1986

[86] PCT No.: PCT/GB86/00409

§ 371 Date: Mar. 4, 1987

§ 102(e) Date: Mar. 4, 1987

[87] PCT Pub. No.: WO87/00572

PCT Pub. Date: Jan. 29, 1987

[30] Foreign Application Priority Data

Jul. 19, 1985 [GB] United Kingdom ..... 8518218

[51] Int. Cl.[4] ..... E21B 34/10

[52] U.S. Cl. ..... 166/317; 166/319; 137/70; 137/513.7; 137/515.5

[58] Field of Search ..... 166/316, 317, 318, 319, 166/328, 329, 205; 137/70, 71, 513.3, 513.7, 515, 515.3, 515.5, 515.7

[56] References Cited

U.S. PATENT DOCUMENTS

Re. 24,659 6/1959 Clark .
3,473,609 10/1969 Allen ..... 166/317
3,599,713 8/1971 Jenkins ..... 166/317
3,776,258 12/1973 Dockins, Jr. ..... 137/269
4,114,704 9/1978 Maurer et al. ..... 175/107
4,510,994 4/1985 Pringle ..... 166/156

FOREIGN PATENT DOCUMENTS 0874985 10/1981 U.S.S.R. ..... 166/329
1094948 5/1984 U.S.S.R. ..... 166/317
2048996 12/1980 United Kingdom .

*Primary Examiner*—George A. Suchfield
*Assistant Examiner*—Bruce M. Kisliuk
*Attorney, Agent, or Firm*—Bell, Seltzer, Park & Gibson

[57] ABSTRACT

A drop-ball sub-assembly comprises a tubular casing (4) defining a flushing fluid flow passage adapted for coupling at one end (3) to an inlet pipe (1) and at the other end (23) to an outlet pipe (24). A drop-ball (17) supporting member (8) is secured within the casing (4) in the flow passage. Apertures (21) are arranged to allow fluid flow past the supporting member (8), and a further aperture (9) supports a blow-out device (13) supporting a drop-ball (17) on a side distal from the end (23). The blow-out device (13) and the apertures (21,9) are such that at a first, lower fluid rate from the inlet (3) to the outlet (23) end, fluid flows through said aperture (21) and the blow-out device is retained, and that at a second, higher flow rate the blow-out device (13) is blown out of the further aperture to release the ball (17) through the further aperture (9). The blow-out device suitably comprises a frangible disc.

9 Claims, 6 Drawing Sheets

DROP BALL SUB-ASSEMBLY FOR A DOWN-HOLE DEVICE

This invention relates to a drop-ball sub-assembly for a down-hole device, for example for use in an oil drilling rig or the like, and is particularly but not exclusively, useful in association with down-hole motor devices.

Generally a drilling rig for core retrievel comprises at the drilling end an inner core barrel and an outer barrel coaxially arranged and defining therebetween a flow space for drilling fluid. The inner core barrel needs to be flushed before drilling to remove detritus which may have been picked up during lowering to a drilling position, to exclude such detritus from a drilled core sample. Thus drilling fluid is used to flush the core tube immediately prior to drilling and then, in conventional tube drills, a ball is dropped from the surface to engage a seating at the upper end of the core barrel to cut off the flow of fluid into the core barrel. This is not possible with a rig using a down-hole motor and it has been proposed in GB-2 048 996B to provide a drop-ball sub-assembly below a drive device and above a core barrel, the sub-assembly including a drop-ball normally disposed in a lateral cavity outside a flow passage to the upper end of the core barrel and retained therein by a spring loaded sleeve. In operation flushing fluid is initially directed through the flow passage to achieve flushing and then the flow rate is increased to exert a force on the sleeve to drive it against the bias to register an aperture in the sleeve with the cavity, allowing the ball to drop out into the flow passage and fall onto a seating to close the upper end of the core barrel against flow of fluid thereinto.

Several down-hole tools or specialist devices which are hydraulically operated are dependent upon a change in the flow path of the drilling fluid or similar liquid to activate them or to allow them to carry out their specialist function.

A known method of creating this change in the flow path is to drop a steel ball into the flow path from the surface of the hole and allow the drilling fluid or similar liquid to carry the ball, assisted by gravity down the hole until the ball lodges in a suitably prepared seat within the down-hole tool or specialist device. The lodging of the ball in the seat closes off the main flow path and prevents the fluid from passing further down the hole. An alternative flow path through which the fluid would not normally flow is now the only path available to the fluid. The fluid by travelling down this alternative flow path has changed its course and can be used to perform the desired requirement of the down-hole tool or specialist device.

There are two distinct disadvantages in such a system, namely:

(i) When another down-hole tool is used in the drill-string, i.e. located between the hydraulically operated device and the surface whose design permits fluid flow through the tool but has an insufficient aperture to allow a ball to pass through it, e.g. a hydraulically operated down-hole positive displacement drilling motor or a turbine or a measurement-while-drilling monitor.

(ii) At increased depths when the time lag between dropping the ball from the surface and the ball lodging in the seat provided in the down-hole device is prolonged and is non-productive.

Typical examples where a ball is used to operate down-hole devices are when coring and when retrieving junk from the bottom of the hole using a hydraulically operated junk retriever.

It is an object to provide an improved drop-ball sub-assembly for down-hole use, for example, in conjunction with a core barrel and an outer barrel of a drilling rig in which flushing fluid flow to the core barrel is required before taking a core sample in which a surface indication of the release of the ball and closure of the upper end of the core barrel to flushing fluid flow can readily be ascertained or in conjunction with down-hole tools dependent on change in flow path of drilling fluid or the like to activate them.

A drop-ball sub-assembly for down-hole use according to the present invention comprises a tubular casing defining a flushing fluid flow passage between inlet and outlet ends adapted for coupling at one end to an inlet pipe and at the other end to an outlet pipe, characterised by a drop-ball supporting member secured within the casing in the flow passage, at least one aperture arranged to allow fluid flow past the supporting member, a further aperture in the supporting member supporting a blow-out device against movement toward said other end of the casing, the blow-out device supporting a drop-ball on a side distal from said other end against movement towards said other end, the blow-out device and the apertures being such that at a first, lower fluid flow rate from the inlet to the outlet end, fluid flows through said at least one aperture and the blow-out device is retained in the further aperture and that at a second, higher flow rate the blow-out device is blown out of the further aperture to release the ball through the further aperture.

In one advantageous application the outlet pipe comprises the upper end of a core barrel having an upper seating adapted to be engaged by the drop-ball on blow-out to close the core barrel from downward flow of drilling fluid. Venting ports or passages are suitably provided above the seat for diverting fluid flow when the ball is seated, for example to an outer barrel surrounding the core barrel.

This has the advantage that in use a fall in drill head fluid pressure may be observed when the blow-out device blows and thus release of the ball to close the core barrel may be determined.

Suitably the blow-out device comprises a disc normally closing the further aperture and so mounted and/or of such material that at a pressure differential developed at a flow rate above that required for flushing the disc is blown from the further aperture. The disc may be of plastics material which at the increased flow rate is blown from the further aperture and shatters such that the ball is freed therefrom. In such arrangement the ball is supported on the upstream side of the disc and has a diameter less than that of the further aperture so that the ball may drop or be driven by fluid flow freely therethrough. In one embodiment the drop-ball supporting member is a cylindrical seat member releasably secured within the casing and having an outer annular array of apertures for fluid flow distributed around a central aperture within which the blow-out disc is mounted. The blow-out disc comprises an outer annular flange which is located within a bore extending from the aperture on the upstream side and of larger diameter to the upstream end of the seat member to provide an annular shoulder on the upstream side of the aperture on which the flange is located. The disc suitably has a central portion within the flange of increased thickness defining a spigot which locates in the aperture, and upper edges of the aperture are suitably sharp.

The disc is retained in the seat member by a sleeve threadably engaging the bore in the seat member and at its downstream end holding the flange against the shoulder. At its upstream end the sleeve projects upstream from the seam member within the annular array of apertures and can be extracted from the drop ball casing along with the seat by breaking out the thread between the inlet crossover and the drop-ball sub casing. The threaded joints between the inlet crossover and the down-hole motor and also between the drop ball sub casing and the core barrel need not be broken out on the drill floor when inserting a new disc. The threaded joint between the sleeve and the seat is made up and broken out with a C-spanner. A slot is milled onto the upper periphery of the sleeve for the hook of a C-spanner.

In another advantageous application the drop-ball sub-assembly is mounted in a drillstring above a down-hole tool arranged for actuation on diversion of fluid flow through an alternative flow path, a seat being provided below the alternative flow path adapted to be closed by the ball on blow-out, against flow of fluid past the seat, so that the fluid is caused to flow through the alternative flow path to effect actuation of the down-hole tool.

The outer casing of the drop-ball sub-assembly suitably comprises a crossover sub-assembly and may be provided with a side venting port or ports downstream of the ball for venting fluid when blow-out occurs.

The invention will now be described, by way of example, with reference to the accompanying partly diagrammatic drawings, in which.

Figure 3:
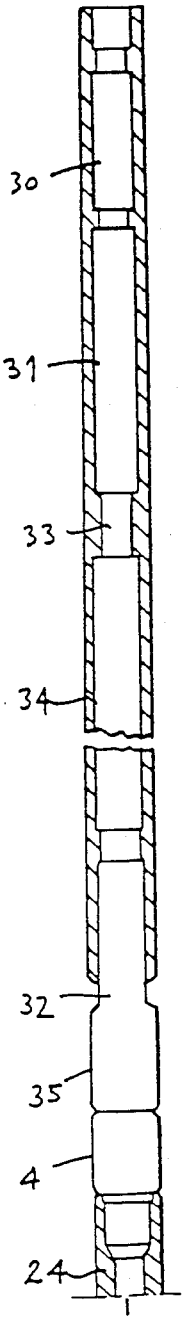
Figure 3:
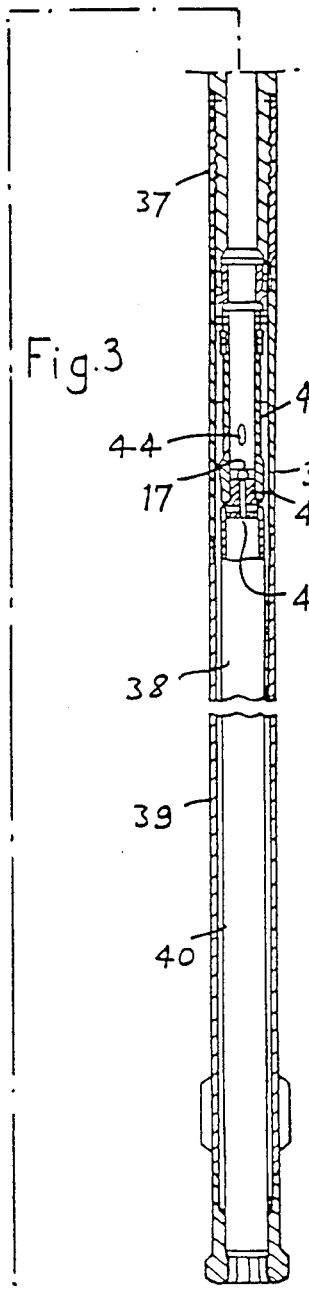
Figure 3A:
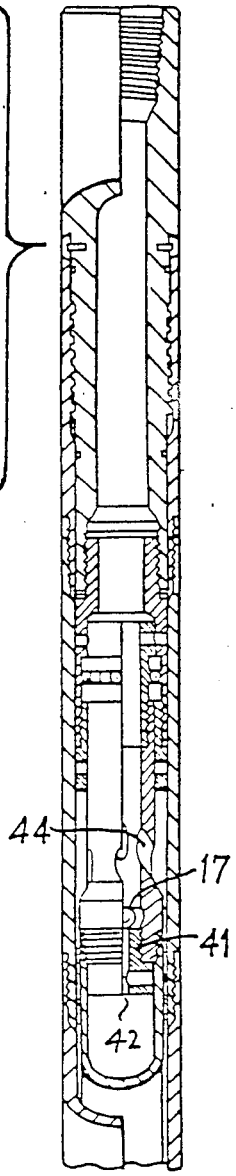
Figure 4:
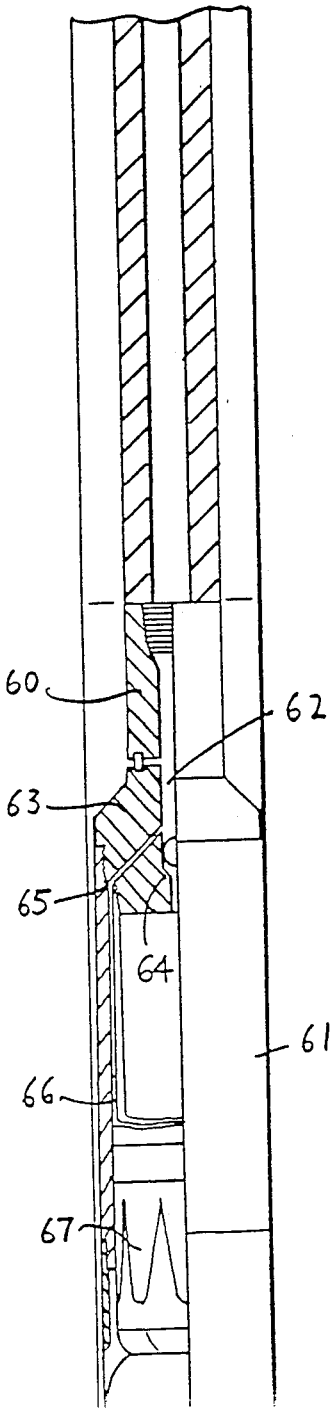
Figure 5:
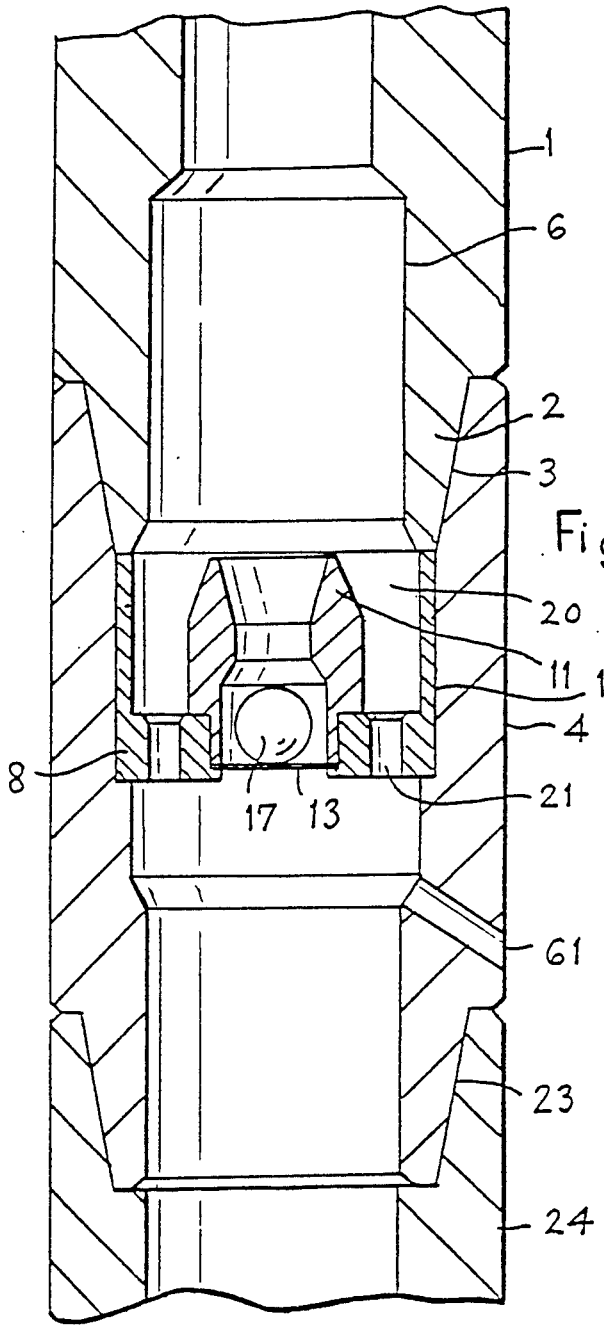

FIG. 3 is a sectional elevation of the lower part of a drilling assembly using a down-hole motor driving a core barrel, with a part enlarged at FIG. 3A, FIG. 4 is a fragmentary partly sectional elevation of the lower part of a modified drilling assembly for junk retrieval, FIG. 5 is a sectional elevation of a modified drop-ball sub-assembly in a lower portion of a drill assembly, FIGS. 6A to 6D are plan views of alternative forms of frangible diaphragms for forming the blow-out device of a drop-ball sub-assembly according to the invention, and FIGS. 7A to 7D are respective cross-sections of the diaphragms of FIGS. 6A to 6D taken on the lines 7—7.

Figure 1:
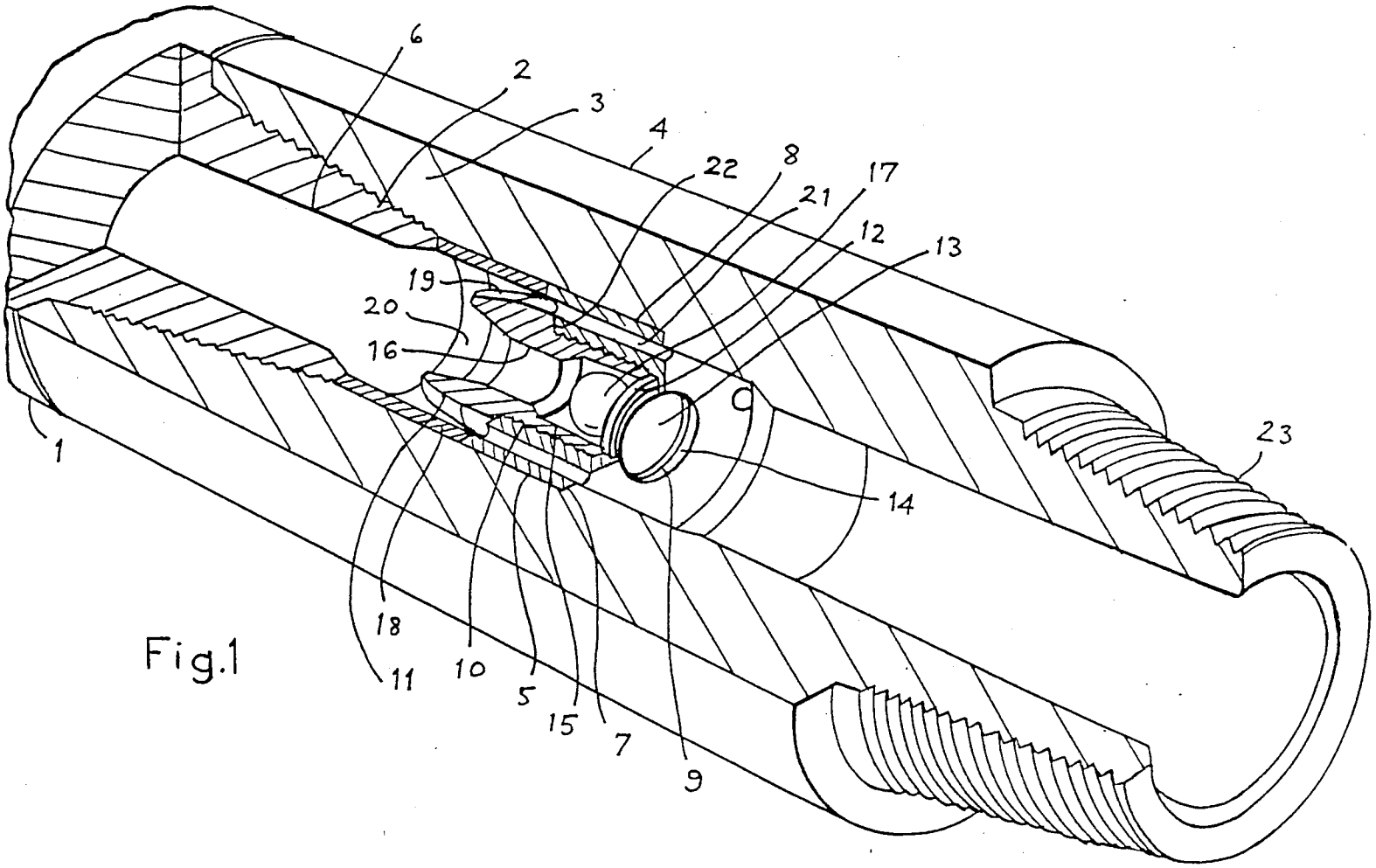
FIG. 1 is a partly sectioned perspective view of a drop-ball sub-assembly secured to the lower end of an inlet crossover.

The inlet crossover 1 of FIG. 1 is formed at its lower end with a lower externally threaded frusto conical male portion 2, threadably engaging a complementary female thread portion 3 at the upper end of the drop-ball sub-assembly 4 which is coaxially bored with respect to the inlet crossover 1. The subassembly 4 comprises a cylindrical casing having an initial bore portion 5 below the inlet crossover 1 of greater diameter than the bore 6 of the crossover 1 and terminating at a lower upwardly facing annular shoulder 7 supporting a cylindrical seat member 8 slidably received in the bore portion 5. The seat member 8 is centrally bored having a lower central aperture 9 and an open upper threaded bore portion 10 of enlarged diameter which threadably receives a holder 11.

The seat member 8 is formed between the bore portion 10 and the aperture 9 with a shallow annular recess 12 of intermediate diameter supporting an outer peripheral portion of a blowout disc 13. The disc has a central circular region 14, of increased, thickness defining a central cylindrical thickened portion extending downwardly into the aperture 9 serving to locate the disc in the aperture 9, and the outer peripheral portion of the disc 13 is clampingly engaged between a lower side of the recess 12 and a lower end of the holder 11. The holder 11 is centrally bored, having a lower bore portion 15 of larger diameter than an upper bore portion 16, the lower bore portion 15 serving to loosely confine a drop-ball 17 of larger diameter than the bore portion 16 and supported on the blow-out disc 13.

The seat member 8 is retained in position against the lower shoulder 7 by means of a spacer sleeve 18 slidably located within the bore portion 5 of the casing of the sub-assembly and clamped between the lower end of the crossover 1 and the upper end of the member 8. The spacer sleeve is suitably dimensional in length to provide an interference or compression between the seat member 8 and the inlet crossover 1 when the crossover 1 and sub-assembly casing 4 are fully engaged. This compression is to secure the seat member 8 against vibration when tripping into hole and thereby protect the blowout disc 13 from vibration damage. The upper end 19 of the holder 11 projects upwardly from the member 8 and is externally tapered upwardly to define an annular flared entry to an annular space 20 between the holder 11 and the spacer sleeve 18 leading to an outer annular portion of the seat member 8. A circumferentially spaced series of holes 21 extend through the seat member 8 from the annular space 20 to a lower side of the seat member 8 and communicating with a lower bore portion of the sub-assembly to provide fluid flow passages bypassing the blowout disc 13 and aperture 9.

An outer downwardly facing annular shoulder 22 is suitably formed on the holder 11 to engage an upper surface of the seat member 8 to determine the clamping engagement or interference with the disc 13 and limit it to a safe value.

Figure 2:
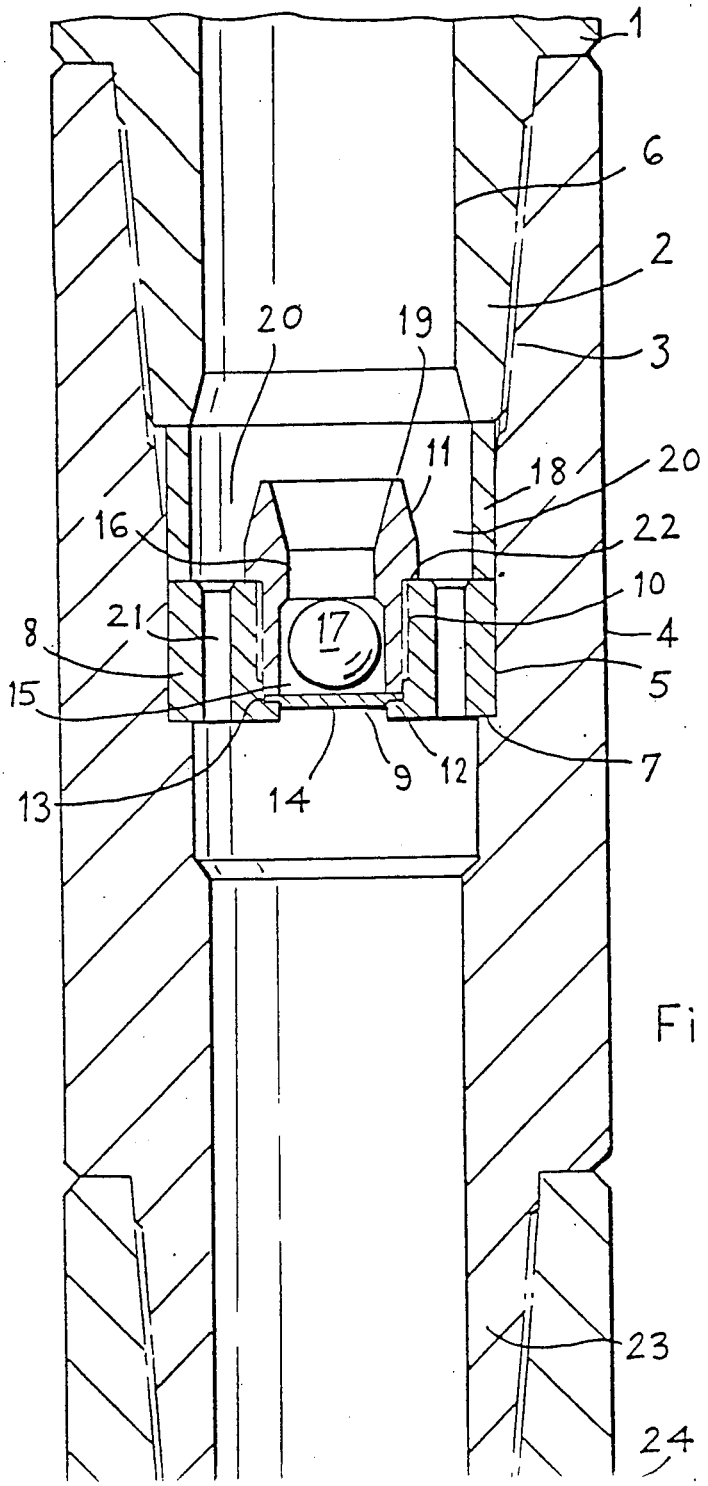
FIG. 2 is a sectional elevation of the drop-ball sub-assembly of FIG. 1 secured between the lower end of the inlet crossover and the upper end of a core barrel.

The lower end of the sub-assembly casing is formed with a downwardly tapering frusto-conical threaded male portion 23 for engaging a complementary threaded recess at an upper end of the core barrel 24 for communication between the through bore of the sub-assembly and the bore of the core barrel 24 as seen in FIG. 2.

The core barrel 24 comprises coaxially arranged inner and outer barrels and defining therebetween an outer annular flow space for drilling fluid and an inner core receiving space having at an upper end an opening for the inflow of flushing fluid and defining a seat for the drop-ball 17 whereby the flow of flushing fluid may be cut-off on dropping the ball 17. A ball of 1¼", 3.18 cm diameter is suitable for use with 6¼"×4", 17.15 cm ×10.2 cm and 8"×4", 20.4 cm ×10.2 cm. core barrels.

The blow-out disc 13 is suitably of plastics material —e.g. VICTREX PEEK material —and is designed to fail or shear under fluid pressure when, for example in use with a 6¼ inch ×4 inch 17.15 cm ×10.2 cm metric core barrel, the flow rate through the inlet crossover exceeds a flow rate of 250 gallons per minute 1.138 kg/min, by at least 50 gallons per minute, 228 kg/min. In an embodiment the aperture 9 has a diameter of approximately 35 mm, the six bores 21 each have a diameter of 10 mm, and the disc 13 has a diameter of approximately 46 mm and a rim thickness, i.e. outside the thickened central spigot, of 5 mm. The inner edge of the shoulder defined by the recess 12 is sharp and square at its juncture with the aperture 9.

In use, with the ball 17 and disc 13 in the position shown FIG. 2 and the drill head just off bottom, fluid is pumped downwardly to the inlet crossover at relatively low pressure and the flow rate is increased slowly up to 250 gallons per minute 1.138 kg/min to close the down hole motor bypass valve e.g. to 250 gallons/minute, 1.138 kg/min when initial flushing of the inner core barrel takes place. The flushing fluid flows through the crossover 1, and by passes the blow out disc 13, flowing through the bores 21 into the lower bore portion of the sub-assembly 4 and thence into the inner core barrel for flushing purposes. When flushing is completed, the flow rate is increased in stages or steps as slowly as possible e.g. in steps of 50 gallons/minute, 227.5 kg/min. At each step there should be a delay to allow the standpipe pressure to level out before moving to the next stage, to be observed at the well-head, until the blow-out disc 13 shears. When the disc 13 shears, the ball 17 drops to seat at the upper end of the inner core barrel and prevent inflow of flushing fluid. Fluid now flows to the annular space between the inner and outer core barrels. When the disc 13 shears the aperture 9 is opened on passage of the ball for flow of fluid, thereby causing a decreased resistance to fluid flow and an observable fall in pressure occurs, which may be observed at the well-head, to indicate that the ball 17 has dropped and the inner core barrel is closed to flow of flushing fluid. Since the diversion of fluid flow from the inner barrel to the annular space between the inner and outer barrels will also result in a pressure rise, the observable fall in pressure will not be as high as theoretically predicted, but for example, at 23° C. a theoretical pressure drop of 561 psi, 39.37 kg/cm$^2$ should be obtained across the drop-ball assembly and at 100° C. a drop of 444 psi, 31.21 kg/cm$^2$.

Table 1 below lists theoretical flow rates at which the blow-out disc in the embodiment exemplified above should shear for muds of density 8.35, 12 and 17 lbs/gallon, 0.835, 1.2 and 1.7 kg/liter and also for temperature of 23° C. and 100° C. As can be seen the maximum flow rate at which the disc should shear is 685 gallons/minute, 3.116 liters/minute for water at room temperature and the minimum rate of 427 gallons/minute, 1943 liters/minute for mud of density 17 lbs/gallon, 1.7 kg/liter and at 100° C.

TABLE 1

| Temp | Flow Rate (CPM) | | | ΔP1 (PSI) | | | ΔP2 (PSI) | | | ΔP1-ΔP2 (PSI) | | |
|---|---|---|---|---|---|---|---|---|---|---|---|---|
| (°C.) | A | B | C | A | B | C | A | B | C | A | B | C |
| 23 | 685 | 572 | 480 | 678 | 678 | 678 | 117 | 117 | 117 | 561 | 561 | 561 |
| 100 | 610 | 509 | 427 | 537 | 537 | 537 | 93 | 93 | 93 | 444 | 444 | 444 |

A: Water at 8.35 lb/gall
B: Mud at 12 lb/gall
C: Mud at 17 lb/gall
ΔP1: Pressure drop across the drop ball sub to shear the disc
ΔP2: Pressure drop across the drop ball sub after the disc has sheared

TABLE 1 in metric units

| Temp | Flow Rate Liters/min | | | ΔP1 (kg/cm$^2$) | | | ΔP2 (kg/cm$^2$) | | | ΔP1-ΔP2 (kg/cm$^2$) | | |
|---|---|---|---|---|---|---|---|---|---|---|---|---|
| (°C.) | A | B | C | A | B | C | A | B | C | A | B | C |
| 23 | 3117 | 2603 | 2184 | 47.7 | 47.7 | 47.7 | 8.23 | 8.23 | 8.23 | 39.5 | 39.5 | 39.5 |
| 100 | 2776 | 2316 | 1943 | 37.8 | 37.8 | 37.8 | 6.54 | 6.54 | 6.54 | 31.3 | 31.3 | 31.3 |

A: Water at 0.835 kg/liter
B: Mud at 1.2 kg/liter
C: Mud at 1.7 kg/liter
ΔP1: Pressure drop across the drop ball sub to shear the disc.
ΔP2: Pressure drop across the drop ball after the disc has sheared.

FIGS. 3 and 3A illustrate a drop-ball sub-assembly 4, as described in connection with FIGS. 1 and 2, in a drilling assembly for mounting at the down-hole end of a drill string. The drilling assembly comprises an upper dump valve 30, above a down-hole positive displacement drilling motor 31 arranged to drive a lower output shaft 32 through a transmission 33 passing through a bearing section 34. The transmission 33 terminates in a bit box 35 coupled to the upper end of the drop-ball sub-assembly 4 which is coupled to the upper end of a core barrel assembly 36. The core barrel assembly 36 has an upper safety joint section 37 coupled to a coaxial assembly of inward inner and outer core barrels 38,39 with a flow path 40, therebetween. A drop-ball seat member 41 is mounted at the upper end of the inner core barrel 38 with a central flow path 42 leading to the inner core barrel 38, and providing an upper seating for the ball 17 of the drop-ball sub-assembly 4. The member 41 is mounted at the lower end of a sleeve 43 defining the flow path leading downwardly from the drop-ball sub-assembly and above the member 41 the sleeve 43 is formed with a circumferential series of downwardly and outwardly inclined ports 44 leading to the flow space 40 between the inner and outer core barrels 38,39.

In initial operation of the drilling assembly of FIG. 3, the drop ball 17 is supported in the sub-assembly 4 and drilling fluid flows through the motor 31 downwardly through the drop-ball sub-assembly ports or nozzles 21, past the ball 17 and its passage 42 of member 41 and through the inner core barrel. When flow through the inner core barrel is no longer required, for example, after flushing and before coring, the fluid flow rate is increased until the blow-out disc 13 of the drop-ball sub-assembly ruptures, causing the ball 17 to fall or be driven by the drilling fluid downwardly to lodge on the seat provided by the member 41 to close the flow path 42 and flow to the inner core barrel 38. Fluid is now caused to flow through the alternative flow path provided by the ports 44 into the flow path 40 between the inner and outer core barrels 38,39 to the core head at the lower end of the assembly.

In FIG. 4 a drilling assembly is shown in a down-hole position, and comprises an hydraulically operable device in the form of a junk retriever 60 having an outer barrel 61 having a central flow passage 62 through a head portion 63 containing a drop-ball seat 64 disposed below a downwardly and outwardly inclined alternative flow path 65 leading to an hydraulic actuator 66 adapted to operate a lower circumferential series of fingers 67 disposed within a lower end of a cylindrical casing of the junk retriever device. On activation of the actuator 66 the fingers are driven downwardly to pivot their lower ends inwardly to close the lower end of the casing to captivate any material within the casing so that it may be retrieved and withdrawn from the hole on withdrawal of the drillstring. In initial operation and lowering of the junk retriever down the hole the fingers 67 are in this open condition shown, and a drop-ball sub-assembly of the kind described above in connection with FIGS. 1 and 2, but not shown, is located above the junk retriever in the drillstring assembly. When it is desired to operate the fingers 67 the flow of fluid through the drop-ball sub-assembly is increased until the disc ruptures and the ball 17 is driven downwardly onto the seat 64 to close the central flow passage and cause fluid to flow through the alternative flow path to activate the actuator and close the fingers.

The drop-ball sub-assembly is suitably located above a down-hole tool or specialist device to be actuated but below any other tool or device in the drillstring, for example, a down-hole motor, which would prevent the ball passing through. Where no other drilling tool or device is being run other than the tool or device to be actuated then the drop-ball sub-assembly should be located immediately above the down-hole device to be actuated.

In the embodiment of FIG. 5 where like reference numerals are used for parts corresponding to those in the embodiment of FIGS. 1 and 2, side venting ports 61 are formed below the blow-out disc 13, directed downwardly and outwardly through the casing of the sub-assembly 4. The ports are distributed around the casing and are suitably adapted to receive releasable nozzles which may be selected to regulate the fluid flow rate therethrough according to hydraulic requirements, or releasable plugs to blank-off selected venting ports 61. In use the sub-assembly is positioned in a lower part of a drillstring assembly, generally as described with reference to FIG. 3, above a seat for the ball 17 through which a main fluid flow path passes. When the fluid flow is increased to a rate at which the disc 13 ruptures and the ball 17 is blown out by the fluid flow and driven against the seat, the main fluid flow path is closed. An alternative fluid flow path will be provided generally as described in connection with FIGS. 3 and 4 for the flow of fluid to a down-hole tool or between inner and outer core barrels. The effect of the vent ports 61 is to allow for increased flow of fluid than might be required by the down-hole tool or device and thereby allow the higher flow rate through the down-hole motor or turbine disposed above the drop-ball sub-assembly with consequent generation of increased power.

In addition to the use of replaceable nozzles in the venting ports 61 it is advantageous to employ replaceable nozzles in the bores 21 bypassing the drop-ball 17 and disc 13 so that fluid flow rate therethrough may be regulated by selection of appropriate nozzles to suit hydraulic requirements.

Figure 6A:
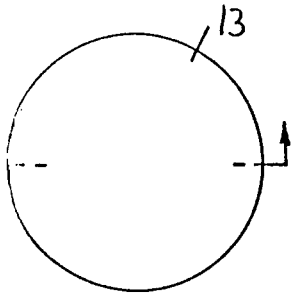
Figure 6B:
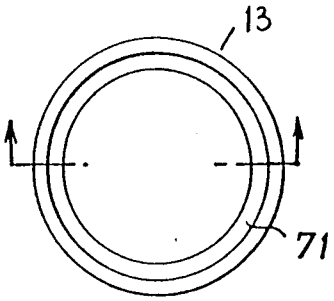
Figure 6C:
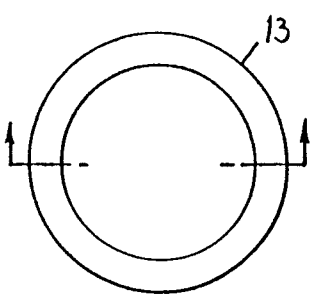
Figure 6D:
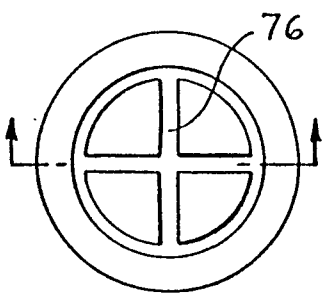
Figure 7A:
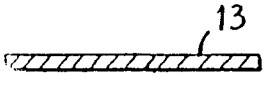
Figure 7B:
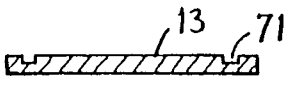
Figure 7C:
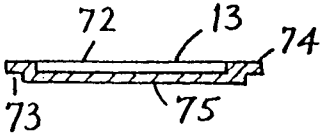
Figure 7D:
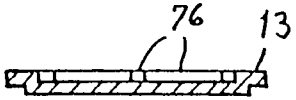

The blow-out disc 13 may be of various forms but is suitably adapted on rupture to fragment into at least three pieces so as readily to be discharged and without risk of preventing proper seating of the ball 17 on its lower seat. In its simplest form as shown in FIGS. 6A and 7A the disc 13 is flat circular and of uniform cross-section. As shown in FIGS. 6B and 7B the disc 13 may be flat circular and of generally uniform cross-section but formed close to its periphery with an annular recess 71 on one side, thereby reducing the thickness and preventing a weakened peripheral zone to facilitate rupture on blow-out. In the embodiment of FIGS. 6C and 7C the disc 13 is formed in its upper side with a concentric circular recess 72 of uniform depth and on its lower side with a peripheral annular recess 73 of larger internal diameter than the upper recess 72 defining an upper peripheral flange or edge portion 74, for support on the recess 12 of the seat member 8 of a drop-ball sub-assembly, and a central flat portion 75 displaced downwardly therefrom. The embodiment of FIGS. 6D and 7D is generally of the form of that of FIGS. 6C and 7D but with a cruciform arrangement of radial ribs 76 formed integrally therewith within the upper circular recess 72 and dividing the recess into quadrants 77. The quadrant pattern effect on the upper, ball retaining surface of the disc causes the disc to rupture in segments on blow-out. The discs of FIGS. 6B 6C and 6D are examples of how stress points for predictable shear fracture can be obtained and are not exhaustive.

We claim:

1. A drop-ball sub-assembly for down-hole use comprising a tubular casing (4) defining a flushing fluid flow passage between inlet (3) and outlet (23) ends adapted for coupling at the inlet end (3) to an inlet pipe (1) and at the outlet end (23) to an outlet pipe (24), characterized by a drop-ball (17) supporting member comprising a cylindrical body (8) secured within the casing (4) in the flow passage, at least one aperture (21) extending longitudinally of the cylindrical body through a wall thereof and forming a passage from end to end of said supporting member and arranged to allow fluid flow past the supporting member (8), a further central cylindrical aperture (9) extending through the supporting member (8) and surrounded by said cylindrical body, a blow-out device (13) closing said further aperture and supported by the cylindrical body against movement toward said outlets end (23) of the casing, the blow-out device (13) comprising a disc-like member and supporting a drop-ball (17) of smaller diameter than said further aperture on a side distal from said outlet end (23) against movement towards said outlet end (23), the blow-out device (13) and the apertures (21,9) being such that at a first, lower fluid flow rate from the inlet (3) to the outlet (23) end, fluid flows through said at least one aperture (21) and the blow-out device is retained in and maintains closed the further aperture (9), and that at a second, higher flow rate the blow-out device (13) is blown out of the further aperture to release the ball (17) through the further aperture (9) and said outlet end.

2. A drop-ball sub-assembly as claimed in claim 1, in which the disc-like member is frangible.

3. A drop-ball sub-assembly as claimed in claim 1, characterised in that the drop-ball supporting member (8) is releasably mounted in the casing (4) and having an array of said at least one apertures (21) distributed about the further aperture (9) which further aperture is centrally disposed and coaxial with said cylindrical support member.

4. A drop-ball sub-assembly as claimed in claim 3, characterised in that the disc-like member has an annular peripheral flange portion located within a cylindrical bore (5) extending coaxially from the further aperture (9) on the upstream side of said further aperture and or larger diameter than the further aperture (9) to the upstream end of the supporting member (8) to define an annular shoulder (12) on the upstream side of the further aperture (9) on which the flange portion is located.

5. A drop-ball sub-assembly as claimed in claim 4, characterised in that the disc-like member is retained in the support member (8) by a sleeve [11) threadably engaging the bore (5) and holding the disc. (13) against the shoulder (12).

6. A drop-ball sub-assembly as claimed in claim 5, characterised in that the sleeve (11) projects upstream from the support member (8) within the array of said at least one apertures (21).

7. A drop-ball sub-assembly as claimed in claim 6, characterised in that the sleeve (11) is of reduced internal diameter at its upstream end (16) and the reduced internal diameter is less than that of the drop-ball (17).

8. A drop-ball sub-assembly as claimed in claim 1 characterised in that the casing (4) on the downstream side of the blow-out device is formed with at least one venting port in a side thereof.

9. A drop-ball sub-assembly as claimed in claim 1 mounted in a drilling assembly for use at the lower end of a drillstring, characterised in that the drilling assembly comprises a ball seat member (41) defining a central flow path (42) past a ball-seat for the ball (17) of the drop-ball sub-assembly which is disposed in the drilling assembly above the ball-seat with a free fluid flow passage therebetween of larger diameter than the ball (17), the ball-seat member (41) being formed on an upstream side of the ball-seat with at least one lateral port defining an alternative fluid flow path, whereby on flowing fluid through the drill assembly at a rate sufficient to cause blow-out of the disc-like member the ball (17) is carried to the seat of the seat member (41) to close the central flow path (42) and cause fluid to flow through the alternative flow path.

* * * * *

UNITED STATES PATENT AND TRADEMARK OFFICE

CERTIFICATE OF CORRECTION

PATENT NO. : 4,796,704

DATED : January 10, 1989

INVENTOR(S) : John Forrest, William Stewart, Rory Tulloch

It is certified that error appears in the above-identified patent and that said Letters Patent is hereby corrected as shown below:

Column 4, line 59, "6 1/4" should be -- 6 3/4 --.

Column 4, line 64, "6 1/4" should be -- 6 3/4 --.

Column 5, line 37, "by passes" should be -- bypasses --.

Column 8, line 49, "outlets" should be -- outlet --.

Signed and Sealed this

Fourth Day of July, 1989

*Attest:*

*Attesting Officer*

DONALD J. QUIGG

*Commissioner of Patents and Trademarks*

UNITED STATES PATENT AND TRADEMARK OFFICE

CERTIFICATE OF CORRECTION

PATENT NO. : 4,796,704

DATED : January 10, 1989

INVENTOR(S) : John Forrest, William Stewart, Rory Tulloch

It is certified that error appears in the above-identified patent and that said Letters Patent is hereby corrected as shown below:

On the face of the patent "Assignee: Drilex UK Limited, New Pigsligo, Scotland" should be -- "Assignee: Drilex UK Limited, London, UK --.

Signed and Sealed this

Fifth Day of December, 1989

*Attest:*

JEFFREY M. SAMUELS

*Attesting Officer*

*Acting Commissioner of Patents and Trademarks*